US008134427B2

(12) United States Patent
Fujita

(10) Patent No.: US 8,134,427 B2
(45) Date of Patent: Mar. 13, 2012

(54) WAVEGUIDE TUBE FORMED BY LAMINATING A PLATE AND SUBSTRATES HAVING WAVEGUIDE PASSAGES

(75) Inventor: Akihisa Fujita, Anjo (JP)

(73) Assignee: Denso Corporation, Kariya (JP)

( * ) Notice: Subject to any disclaimer, the term of this patent is extended or adjusted under 35 U.S.C. 154(b) by 163 days.

(21) Appl. No.: 12/381,027

(22) Filed: Mar. 6, 2009

(65) Prior Publication Data

US 2009/0224857 A1 Sep. 10, 2009

(30) Foreign Application Priority Data

Mar. 6, 2008 (JP) ..... 2008-056397

(51) Int. Cl.
*H01P 3/18* (2006.01)

(52) U.S. Cl. ..... 333/239; 333/26; 333/33

(58) Field of Classification Search ..... 333/239, 333/248, 137, 26, 33
See application file for complete search history.

(56) References Cited

U.S. PATENT DOCUMENTS

| | | | | |
|---|---|---|---|---|
| 3,292,115 | A * | 12/1966 | La Rosa | 333/208 |
| 5,821,836 | A * | 10/1998 | Katehi et al. | 333/202 |
| 6,154,176 | A * | 11/2000 | Fathy et al. | 343/700 MS |
| 6,590,477 | B1 * | 7/2003 | Elco | 333/239 |

FOREIGN PATENT DOCUMENTS

| | | |
|---|---|---|
| JP | 56-067947 | 6/1981 |
| JP | 61-245704 | 11/1986 |
| JP | 2001-136008 | 5/2001 |
| JP | 2003-087009 | 3/2003 |
| JP | 2004-22178 | 8/2004 |
| JP | 2004-221718 | 8/2004 |
| JP | 2007-266866 | 10/2007 |

OTHER PUBLICATIONS

Office action dated Dec. 1, 2009 in corresponding Japanese Application No. 2008-056397.

* cited by examiner

*Primary Examiner* — Benny Lee
(74) *Attorney, Agent, or Firm* — Harness, Dickey & Pierce, PLC

(57) ABSTRACT

There are provided a waveguide plate that is made of metallic plates through which through holes are formed and a pair of resin made substrates (first and second substrates) on which a grounding pattern is formed to cover the through holes. Both the waveguide plate and the substrates are laminated with each other using a conductive adhesive such that the waveguide plate is sandwiched by the substrates, whereby a rectangular waveguide is provided. The first substrate has high frequency circuits such as an oscillator that generates high frequency signals. The high frequency signals generated by the oscillator are supplied to an antenna section that is formed on the second substrate via the rectangular waveguide.

15 Claims, 8 Drawing Sheets

WAVEGUIDE TUBE FORMED BY LAMINATING A PLATE AND SUBSTRATES HAVING WAVEGUIDE PASSAGES

CROSS-REFERENCE TO RELATED APPLICATION

This application is related to Japanese Patent Application NO. 2008-56397 filed on Mar. 6, 2008, the contents of which are hereby incorporated by reference.

BACKGROUND OF THE INVENTION

1. Field of the Invention

The present invention relates to high frequency devices and, in particular, to a high frequency device provided with a rectangular waveguide tube that is capable of transmitting high frequency signals.

2. Description of the Related Art

Conventionally, a high frequency device that is capable of transmitting high frequency signals using rectangular waveguide tubes is known. For example, Japanese Patent Laid-open publication No. 2004-221718 discloses a high frequency device that is capable of transmitting high frequency signals, in which two metallic plates are joined and a plurality of rectangular waveguide tubes are formed on the joint surface.

In this type of high frequency device, forming a groove on at least one metallic plate is necessary to make a rectangular waveguide tube. In this regard, it is required to process the metallic plate to be a complex shape, which makes manufacturing the device difficult.

In addition, the high frequency device having joined metallic plates has problems such as being heavy, and requiring an additional high frequency circuit board for processing signals being transmitted through the waveguide tube. Furthermore, there can be a problem that thickness of the device is increased when the high frequency board is laminated to the metallic plates.

Since the metallic plates cannot be joined using an adhesive, the metallic plates are joined using screws. Therefore, it is necessary to secure space for the screws, which makes the scale of the device increase.

SUMMARY OF THE INVENTION

The present invention has been developed to solve the above described issues. An object of the present invention is to provide a high frequency signal transmitting device having a lightweight and thin body. To achieve the above-described object, a high frequency device equipped with a waveguide tube unit that transmits a high frequency signal, the waveguide having a rectangular waveguide passage through which the high frequency signal is transmitted, the waveguide passage extending in a longitudinal direction thereof and having a rectangle section cut perpendicularly to the longitudinal direction, the rectangle section consisting of short side edges and long side edges, the device comprising: a plate having a thickness corresponding to a length of the short side edges of the waveguide passage and having a through hole formed through the mutually-opposite surfaces of the plate in a direction of the thickness, the through hole having a width perpendicular to the longitudinal direction, having an inner wall and openings opened at the surfaces, wherein at least the inner wall and edges of the openings are given electrical conductivity; and a pair of substrates, each substrate being made of resin and laminated on each of the mutually-opposite surfaces of the plate and having grounding patterns connected to the ground, the grounding pattern being located at a specified region of a surface of each of the substrates, the specified region positionally corresponding to the waveguide passage formed in the plate, the plate and the pair of substrates composing the waveguide tube unit.

DETAILED DESCRIPTION OF THE PREFERRED EMBODIMENTS

Embodiments of a high frequency signal transmitting device of the present invention will hereinafter be described by reference to the accompanying drawings.

(First Embodiment)

Referring to FIGS. 1A, 1B 2A and 2B a first embodiment will now be described.

Figures 1A, 1B:
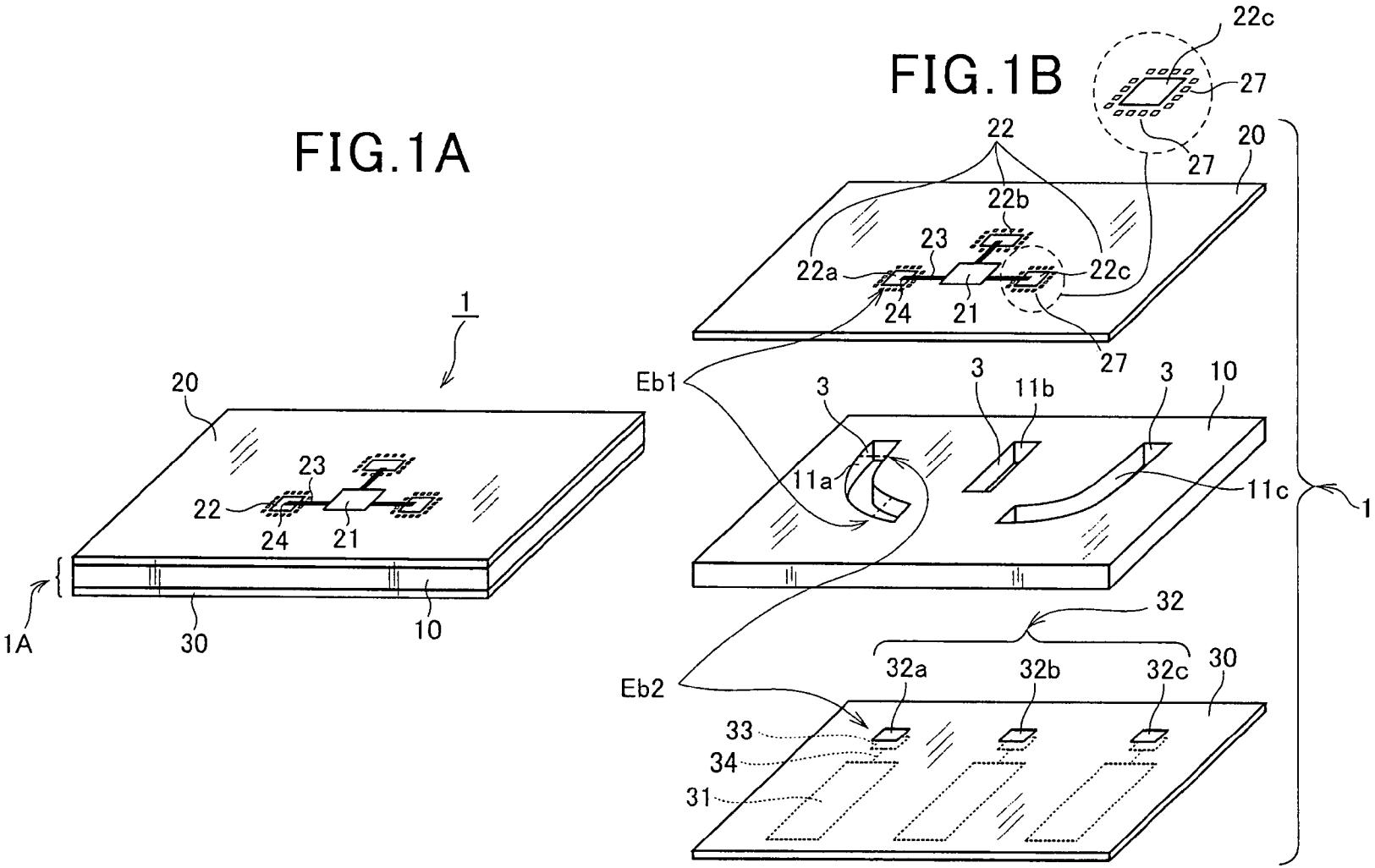
FIG. 1A is a perspective view showing an overall configuration of a high frequency signal transmitting device according to a first embodiment of the present invention.
FIG. 1B is an exploded perspective view showing the overall configuration of the high frequency signal transmitting device according to the first embodiment.

FIG. 1A is a perspective view showing an overall configuration of a high frequency signal transmitting device 1 to which the present invention is applied. FIG. 1B is an exploded perspective view showing the high frequency signal transmitting device 1.

The high frequency signal transmitting device 1, which serves as the high-frequency device according to the present invention, is applied to a radar device using millimeter waves and microwaves.

As shown in FIGS. 1A and 1B, the high frequency signal transmitting device 1 includes a waveguide plate 10, a first substrate 20, and a second substrate 30. A plurality (three according to the first embodiment) of through holes 11*a*, 11*b* and 11*c* as shown in FIG. 1B are formed on the waveguide plate 10 so as to form a rectangular waveguide passage 3. The waveguide plate is made of metallic plate (e.g. conductor). The first substrate 20 and the second substrate 30 are attached to opposite sides of the waveguide plate 10. The through holes 11*a*, 11*b* and 11*c* where the high frequency signal is transmitted, extends in a longitudinal direction thereof and has a rectangle section cut perpendicularly to the longitudinal direction. The rectangle section consist of short side edges and long side edges, the short side edges have the same length of a thickness of the waveguide plate 10.

The first substrate 20 is a substrate made of resin. High frequency circuits are formed (e.g. printed) on a surface (hereinafter referred to circuit-formed-surface) of the first substrate 20 opposite to the joint surface with the waveguide plate 10. The high frequency circuits are, for example, an oscillator 21 that generates high frequency signals, a high frequency signal line 23 formed by strip lines that transmit an output from the oscillator 21 to rectangular areas 22 serving as an input terminal of the rectangular waveguide passage 3, and transitions 24 that converts electrical signals (output from the oscillator 21) provided via the high frequency signal line 23 into electromagnetic waves and emit the electromagnetic waves towards the rectangular waveguide passage 3. The rectangular areas 22*a*, 22*b* and 22*c* as shown in FIG. 1B are arranged corresponding to the through holes 11*a* to 11*c* respectively. All high frequency signal lines 23 which connect the rectangular areas 22 and the oscillator 21 placed on a center of the first substrate 20, are arranged radially such that the lengths of the waveguides are the same.

On the other hand as shown in FIG. 1B, the second substrate 30 is a substrate made of resin, like the first substrate 20. Antenna sections 31, transitions 33, high frequency signal lines 34, are formed (e.g. printed) on a surface (circuit-formed-surface) of the second substrate 30 opposite to the joint surface with the waveguide plate 10, such as to correspond to each of the rectangular waveguide passage 3. The antenna sections 31 are formed by a plurality of patch antennas being arrayed in a single row. The transitions 33 convert the high frequency signals provided via the rectangular waveguide passage 3 into electrical signals at rectangular areas 32 serving as output terminals of the rectangular waveguide passage 3. The rectangular areas 32*a*, 32*b* and 32*c* are arranged in a line along a side of the second substrate 30.

Furthermore, the through holes 11*a*, 11*b* and 11*c* on the waveguide plate 10 are formed such that a center of a portion facing to the rectangular areas 22 of the first substrate and a center of a portion facing to the rectangular areas 32 of the second substrate each locate λg/2 away from the passage-end of the through holes 11*a*, 11*b* and 11*c* (λg refers to a guide wave length of the electromagnetic waves to be transmitted in the waveguide 3). In addition, thickness of the waveguide plate 10 is set to avoid forming standing waves of higher harmonics in the thickness-direction (i.e., short-side / electric field direction) of through holes 11*a*, ll*b* and 11*c*.

Figure 2A:
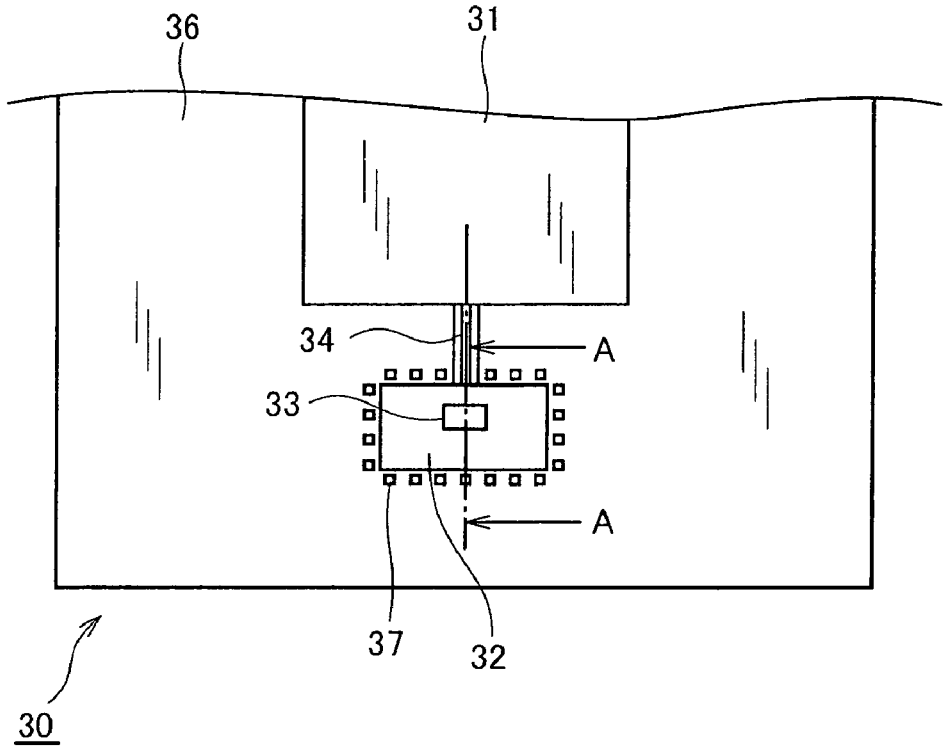
FIG. 2A is a planar view showing a configuration of a vicinity of a rectangular area of a second substrate according to the first embodiment.
Figure 2B:
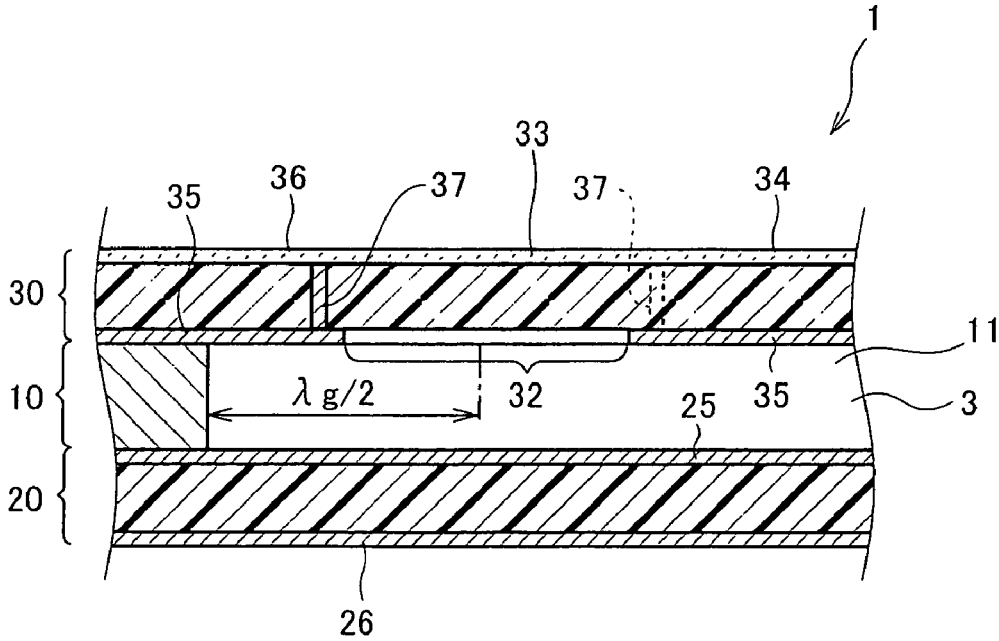
FIG. 2B is a cross-sectional view showing a section along a A-A line taken in FIG. 2A.

FIG. 2A is an enlarged planar view showing a vicinity of the transitions 33 that are formed on the second substrate 30. The enlarged view shows a plane at which the transitions 33 are formed. FIG. 2B is a cross-sectional view showing a section along the A-A line taken in the high frequency signal transmitting device 1.

As shown in F*ig*. 2B, both of the first and second substrates have grounding patterns 25 and 35 formed (printed) on the entire joint surface of the waveguide plate 10 except the rectangular areas 22, 32 being used either input or output terminal of the rectangular waveguide passage 3. Also, circuit-formed-surfaces of the first and second substrates have grounding patterns 26, 36 formed (printed) on the entire surface except a portion at which the high frequency circuit and the waveguides are formed. These grounding patterns are electrically grounded (not shown). Furthermore, plurality of via holes which electrically connect the grounding patterns 25, 35 of the joint surface and the grounding pattern 26, 36 of the circuit-formed surface are arranged in the vicinity of the rectangular areas 22, 32. The via holes are arranged with an interval of λg/4 or less. An area surrounded by those via holes 37 (via holes 27 around the rectangular areas 22 are shown in FIG. 1B) functions as the rectangular waveguide passage (bore-through waveguide in the present invention).

Further, the waveguide plate 10, the first substrate 20 and the second substrate 30 are integrally attached by a conductive adhesive. In other words, the substrates 10 and 30, each substrate are laminated on each of the mutually-opposite surfaces of the waveguide plate 10.

Therefore, in the high frequency signal transmitting device 1, the rectangular waveguide passage 3 which can be referred to a rectangular waveguide tube are formed by the through holes 11 and the grounding patterns 25, 35 of the first and second substrate that cover the through holes 11, and E bends i.e., Eb1 and Eb2 as shown in FIG. 1B for input/output terminals of the rectangular waveguide passage 3 are formed at the rectangular areas 22, 32 surrounded by the via holes 27, for the rectangular areas 22 (see FIG. 1B) and via holes 37 (see FIGS. 2A and 2B) for the rectangular areas 32. Specifically, as shown in FIG. 1B, the E bends i.e., Eb1 and Eb2 at which the E-surface of the waveguide passage is bent in a direction along the short side edge of the waveguide passage 3 (thickness direction of the waveguide plate 10) are formed at the rectangular areas 22 and 32.

In the high frequency signal transmitting device 1 configured as such, the high frequency signals (electrical signals) generated by the oscillator 21 that is mounted on the circuit-formed-surface of the first substrate 20, are supplied to the transitions 24 via the high frequency signal line 23. The high frequency signals (electric signals) are converted to electromagnetic waves by the transitions 24 and then supplied to the rectangular waveguide passage 3 via rectangular areas 22. Moreover, the electromagnetic waves are transmitted to the transitions 33 that are mounted on the circuit-formed-surface of the second substrate 30 via the rectangular waveguide passage 3 and the rectangular area 32 of the second substrate 30. As a result, the high frequency signals (electromagnetic waves) that are supplied to the transitions 33 are converted to electric signals and supplied to the antenna sections 31 via high frequency signal line 34. The electric signals are again converted to the electromagnetic waves at the antenna sections 31 so as to emit the waves. In FIG. 1A, a portion 1A comprising of waveguide plate 10, the first substrate 20 and the second substrate 30 is referred to a waveguide tube unit.

As described above, the high frequency signal transmitting device 1 only requires forming the through holes 11*a*, 11*b* and 11*c* for processing of the waveguide plate 10 in order to provide the rectangular waveguide passage 3. Therefore, unlike a conventional device, complex processing such as forming a groove is not necessary, the high frequency signal transmitting device 1 can be manufactured easily and with low cost.

Also, the high frequency signal transmitting device 1 has the rectangular waveguide passage 3 formed by a pair of plates made of resin (the first substrate 20 and the second substrate 30) joined to the waveguide plate 10. Besides, high frequency circuits that generate/process the high frequency signals to be transmitted via the rectangular waveguide passage 3, are formed on the first substrate 20 and the second substrate 30. Accordingly, it is not necessary to use additional configuration for the high frequency circuit (e.g. plates made of resin) so that configuration of the high frequency circuits is accomplished with a lightweight and thin body.

Moreover, in the high frequency signal transmitting device 1, since the waveguide plate 10, the first substrate 20 and the second substrate 30 are joined by a conductive adhesive, it is not necessary to secure a specific configuration and space for the joint. Therefore, the high frequency signal transmitting device 1 can be downsized and simply structured. The high frequency signal transmitting device 1 corresponds to the high frequency device of the present invention.

(Second Embodiment)

Next, referring to FIGS. 3A and 3B, a second embodiment will now be described.

In this embodiment, only a configuration of the waveguide plate 10 differs from that of the waveguide plate 10 according to the first embodiment. Therefore, a portion of the configuration that differs will mainly be described.

Figure 3A:
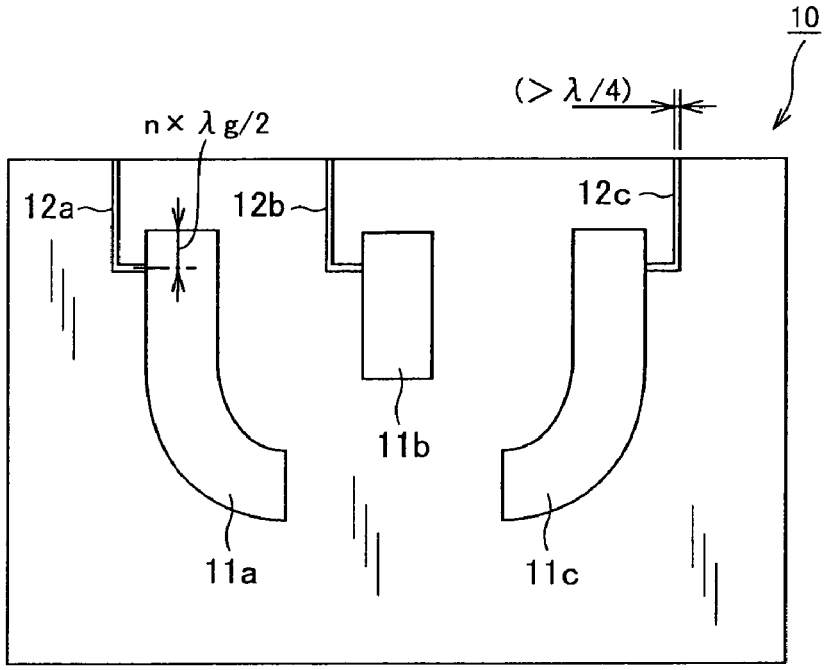
FIG. 3A is a planar view showing a configuration of a waveguide plate according to a second embodiment of the present invention.

FIG. 3A is a planar view showing a joint surface of the waveguide plate 10 at which the waveguide plate 10 and the first substrate 20 are joined.

As shown in FIG. 3A, on the joint surface of the waveguide plate 10 at which the waveguide plate 10 and the first substrate 20 are joined, grooves 12*a*, 12*b* and 12*c* are arranged corresponding to respective through holes 11(11*a* to 11*c*). The grooves work as air passages that allow the air to flow between the rectangular waveguide passage 3 and outside space of the waveguide plate 10.

This groove 12*a*, 12*b* and 12*c* are formed such that end portions at a side of the through holes 11*a*, 11*b* and 11*c* are formed to be at portions that are $n\lambda g/2$ (n is 0 or positive integer number) away from end portions that are facing to rectangular areas 32 (32*a* to 32*c*). Apertures of the groove 12 are equal or less than $\lambda/4$, where $\lambda$ refers to "free space wavelength" of electromagnetic waves to be transmitted.

In the high frequency signal transmitting device 1 configured as such, the air passages by grooves 12 are formed when the waveguide plate 10, the first substrate 20 and the second substrate 30 are joined together, thereby the air flow through the rectangular waveguide passage 3. As a result, even if the air in the rectangular waveguide passage 3 fluctuates in its volume (i.e., expansion or contraction) due to temperature variation or other reason, joint portions of the waveguide plate 10, the first substrate 20 and the second substrate 30, or joint portions between the first/second substrates and circuit parts mounted on those substrates 20, 30 do not suffer any extra force. Thus, a structural reliability of the high frequency signal transmitting device 1 can be enhanced.

(Modification)

The grooves 12*a*, 12*b* and 12*c* forming the air passages are not necessarily arranged on the joint surface of the waveguide plate 10 at which the waveguide plate 10 and the first substrate 20 are joined. However, the grooves 12 may be arranged on the joint surface of the waveguide plate 10 and the second substrate 30.

Also, a configuration to form the air passages (the grooves 1Z in the second embodiment) may be arranged on the joint surface of the first or second substrate (i.e., not the surface of the waveguide plate 10) that are joined to the waveguide plate 10.

Figure 3B:
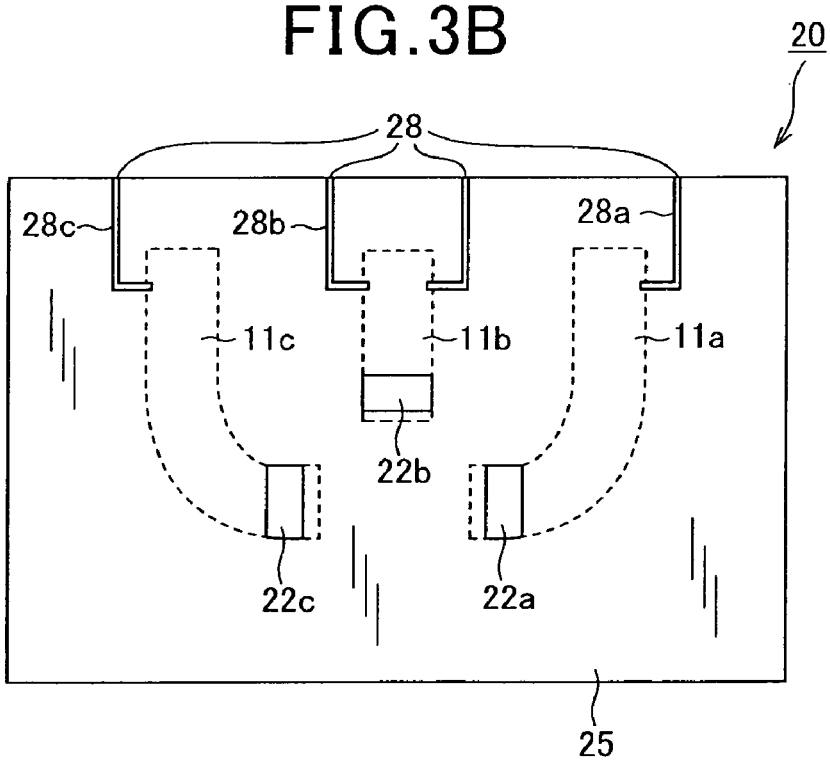
FIG. 3B is a planar view showing a configuration of a first substrate according to a modification of the second embodiment.

In such case, for example, as shown FIG. 3B, in the process of forming the grounding pattern 25 that is formed on the joint surface of the first substrate at which the waveguide plate 10 and the first substrate are joined, portions 28*a*, 28*b* and 28*c* where no grounding pattern exists may be arranged to form the air passages comprising of the portions 28 themselves. Under such conditions, the portions 28 are preferably arranged such that top portions of the portions 28 are protruded to portions facing to the through holes 11*a*, 11*b* and 11*c*.

Besides, FIG. 3B shows the portions 28 arranged on the first substrate 20, the portions where no pattern exists may be arranged on the second substrate 30 as well.

(Third Embodiment)

Next, referring to *Figs*. 4A, 4B and 4C, a third embodiment will now be described.

A high frequency signal transmitting device 5 of the third embodiment is configured as a slot array antenna.

Figure 4A:
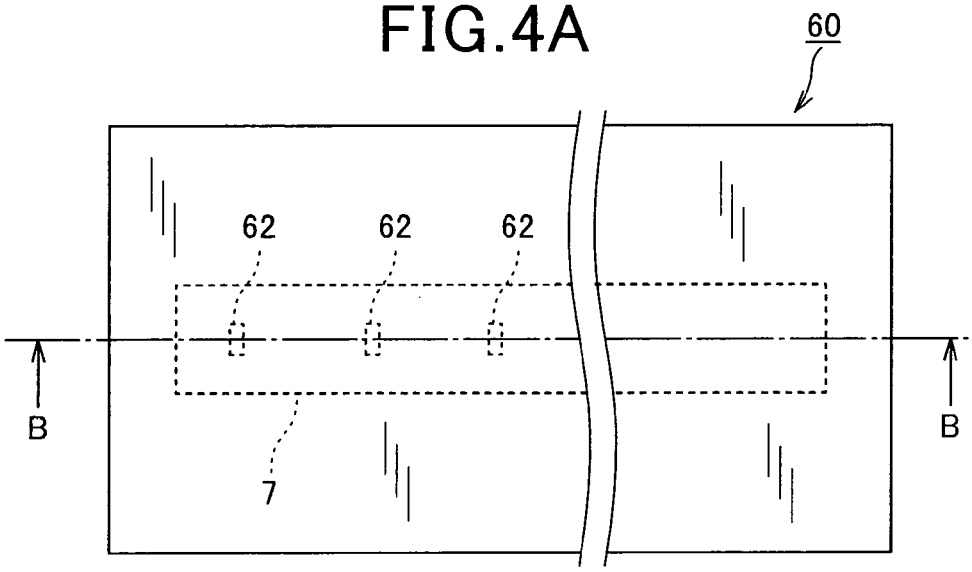
FIG. 4A is a planar view showing a configuration of a high frequency signal transmitting device according to a third embodiment of the present invention.
Figure 4B:
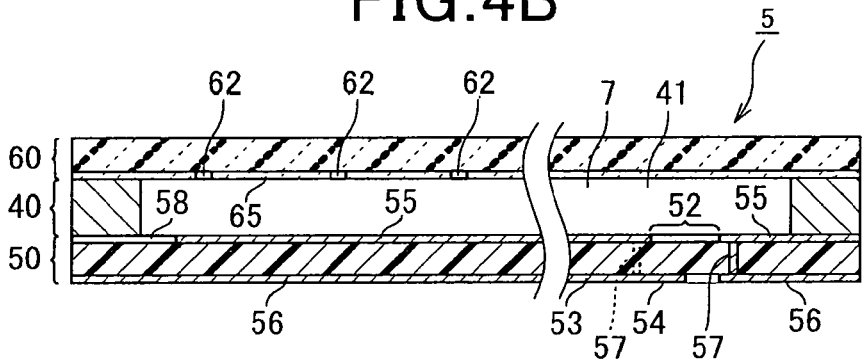
FIG. 4B is a cross-sectional view showing a section along a B-B line taken in FIG. 4A.
Figure 4C:
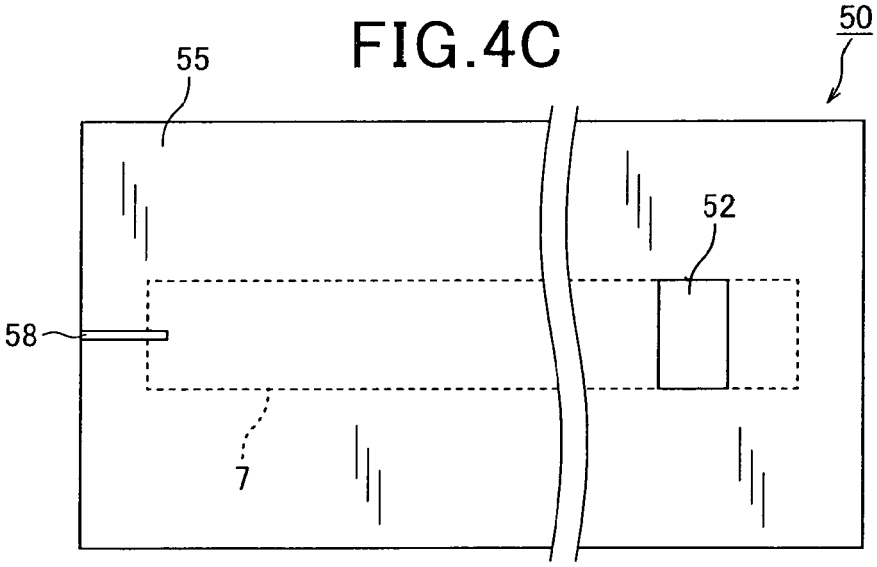
FIG. 4C is a planar view showing a configuration of a joint-plane between a waveguide plate and the first substrate.

FIG. 4A is a planar view showing a configuration of the high frequency signal transmitting device 5. FIG. 4B is a cross-sectional view showing a section along the B-B line taken in FIG. 4A. FIG. 4C is a planar view showing a joint surface of the first substrate at which the waveguide plate and the first substrate are joined.

As shown in FIG. 4B, the high frequency signal transmitting device 5 comprises a waveguide plate 40 which is made of metallic plate, having a through hole 41 used for a rectangular waveguide passage 7, and the first and second substrates 50, 60 as shown in FIG. 4C and 4A, respectively which are joined to opposite side of the waveguide plate 40.

Referring to FIG. 4B, the first substrate 50 is made of resin in which various high frequency circuits are arranged on an opposite side of the joint surface of the waveguide plate 40 (i.e., circuit-formed-surface). The high frequency circuits include an oscillator (not shown) that generates a high frequency signal, a high frequency signal line 53 formed by strip line that transmits an output from the oscillator to rectangular area 52 serving as an input terminal of the rectangular waveguide passage 7, and a transition 54 that converts an electrical signal (output from the oscillator) provided via the high frequency signal line 53 into electromagnetic waves and emit the electromagnetic waves towards the rectangular waveguide passages 7. Further, the grounding pattern 56 (FIG. 4B) is formed on the rest of the area other than those high frequency circuits.

As shown in FIGS. 4B and 4C, on the joint surface of the first substrate 50 at which the first substrate 50 and the waveguide plate 40 are joined, a portion 58 (FIG. 4B and 4C) (having no grounding pattern) as an air passage that allows the air to flow between the rectangular waveguide passage 7 and outside space of the waveguide plate 5. In addition, the grounding pattern 55 (FIGS. 4B and 4C) is formed on the entire portion of the joint surface except a rectangular area 52. Regarding the portion 58, an end portion corresponding to a side of the rectangular wave guide passage 7 has an aperture at a portion confronting to the rectangular portion 52 of the first substrate 50. The portion 58 is formed to have length of aperture equal to or less than $\lambda/4$. Further, plurality of via holes 57 (FIG. 4B), which electrically connect the grounding patterns 55 and 56 are arranged around the rectangular portion 52 with an interval of which length is equal or less than $\lambda g/4$. Accordingly, an E bend for input terminal of the rectangular waveguide passage 7 is formed at the rectangular area 52 surrounded by the via holes 57.

On the other hand as shown in FIG. 4A, the second substrate 60 is made of resin as well as the first substrate 50 and on the joint surface of the waveguide plate 40, a grounding pattern 55 is formed to cover almost all area of the joint surface of the waveguide plate 40. However, plurality of slits 62 (FIGS. 4A and 4B) are formed on a line at a portion that is facing to the through hole 41 (i.e., rectangular waveguide passage 7) of the waveguide plate 40. The plurality of slits 62 are formed along with the through hole 41. The intervals among each slot are set to a predetermined value so as to obtain desired directional characteristics.

In the high frequency signal transmitting device 5, the high frequency signal (electrical signal) generated by the oscillator arranged on the circuit-formed-surface of the first substrate 50 is supplied to the transition 54 via the high frequency signal line 53. Subsequently, the high frequency signal is converted to electromagnetic waves and supplied to the rectangular waveguide passage 7 via the rectangular area 52. Then, the high frequency signal (electromagnetic waves) supplied to the rectangular waveguide passage 7 is emitted externally of the device from each slit 62 formed on the second substrate 60.

As described, in the high frequency signal transmitting device 5, forming the through hole 41 on the waveguide plate 40 is only required to provide the waveguide 7. Also, the rectangular waveguide passage 7 is formed such that a pair of substrates made of resin (the first substrate 50 and the second substrate 60) are joined to the waveguide plate 40 by conductive adhesive. Accordingly, the same effect as the first embodiment can be achieved.

Furthermore, according to the high frequency signal transmitting device 5, the electromagnetic waves transmitted in the rectangular waveguide passage 7 can be emitted externally of the device from the slits 62 without converting the electromagnetic waves into an electrical signal. As a result, the electromagnetic waves can be emitted efficiently. The high frequency signal transmitting device 5 corresponds to the high frequency device of the present invention.

(Modification)

Figure 5A:
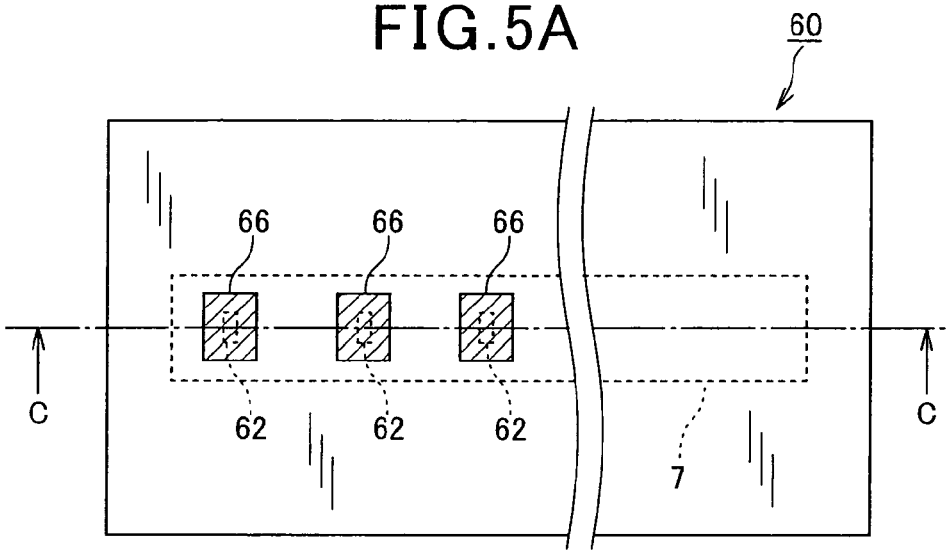
FIG. 5A is a planar view showing a configuration according to a modification of the third embodiment.
Figure 5B:
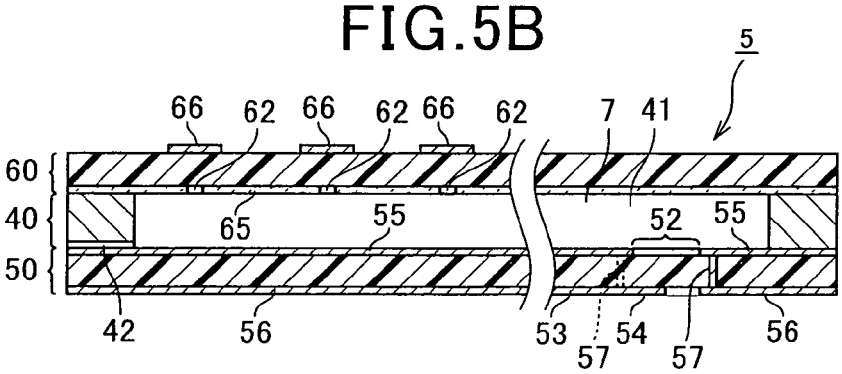
FIG. 5B is a cross-sectional view showing a section along a C-C line taken in FIG. 5A.
Figure 5C:
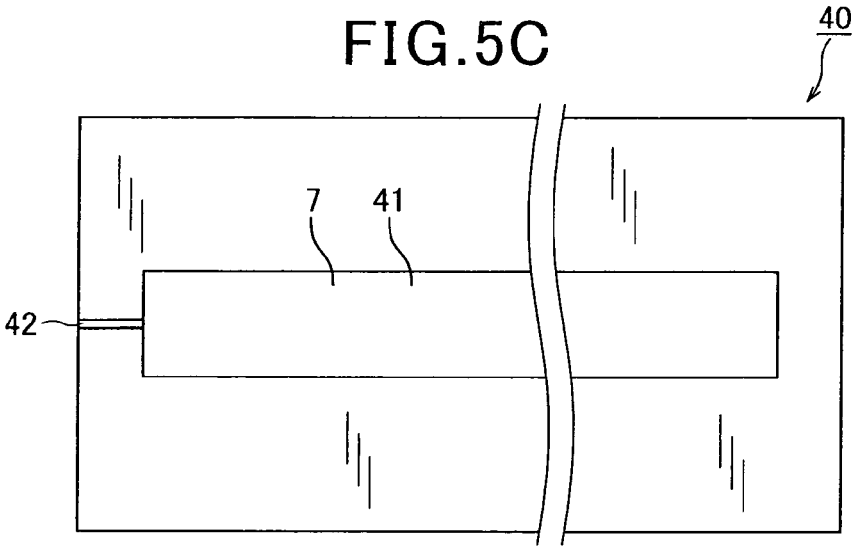
FIG. 5C is a planar view showing a configuration of a joint-plane between a waveguide plate and the first substrate.

FIG. 5A is a planar view showing a configuration of a modification according to the high frequency signal transmitting device. FIG. 5B is a cross-sectional view showing a section along the C-C line taken in FIG. 5A. FIG. 5C is a planar view showing a joint surface of the waveguide plate 40 at which the waveguide 40 and the first substrate 50 are joined.

As shown in FIGS. 5A and 5B, on the surface opposite to the joint surface of the second substrate 60 at which the second substrate 60 and the waveguide plate 40 are joined, a matching device (patch) 66 that is formed by a conductor may be arranged (printed) at a portion facing to the each slot 62. Accordingly, by this modification, it can be enhanced an efficiency of emitting the electromagnetic waves. In addition, various emitting ways may be arranged when the matching device is set to various shapes and sizes.

As shown FIGS. 5B and 5C, the air passage 42 may be arranged on the waveguide plate 40 rather than the first substrate 50. The air passage 42 is formed by a groove on the waveguide plate 40.

(Other Embodiments)

Figure 6A:
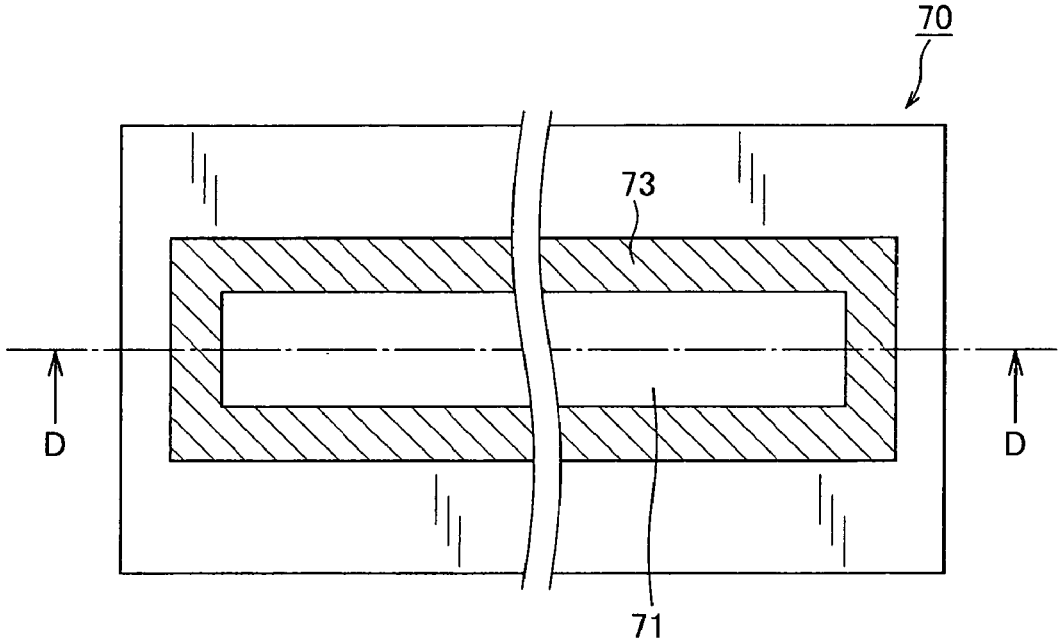
FIG. 6A is a planar view showing a configuration according to the other embodiment.
Figure 6B:
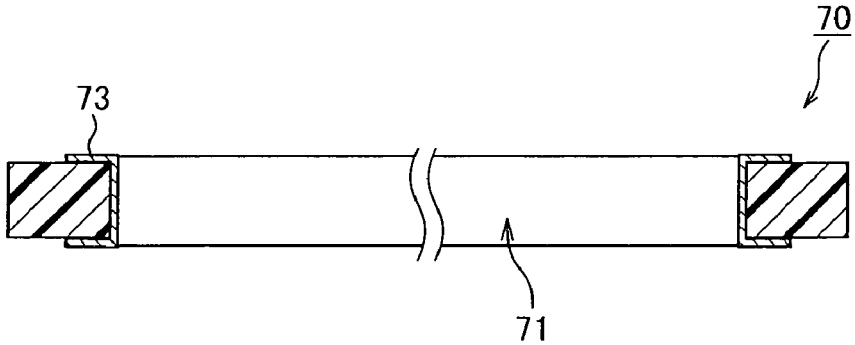
FIG. 6B is a cross-sectional view showing a section along a D-D line taken in FIG. 6A.

According to the above-described embodiments, metallic plates including through holes are used as waveguide plates 10 and 40. However, as shown in *Fig.* 6A, a waveguide plate 70 may be used in place of the waveguide plates 10 and 40. FIG. 6A is a planar view of the waveguide plate 70 and FIG. 6 B is a cross-sectional view showing a section along the D-D line taken in FIG. 6A. The waveguide plate 70 includes a substrate made of resin through which a through hole (i.e., waveguide passage 71) is formed, a grounding pattern 73 that covers an area of an inner-wall surface, and an area of an edge portion of the waveguide 71.

According to the above-described embodiments, the waveguide plate 10 (40), or the first substrate 20 (50), and the second substrate 30 (60) are processed in order to make the air passage. However, when these plates are laminated on one another using the conductive adhesive, a portion at which there is no conductive adhesive can be used as the air passage.

Figure 8:
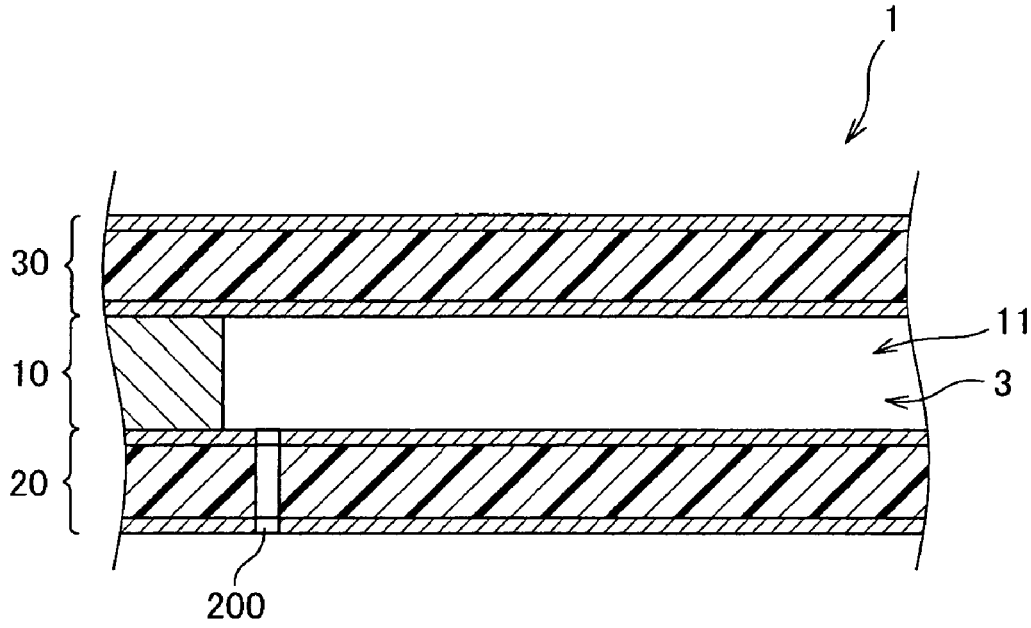
FIG. 8 is a cross-sectional view showing an air passage according to another embodiment.

Furthermore, the air passage may be a through hole (i.e., via hole) that vertically passes through the resin-made substrate, which through hole can be formed as part of circuit wirings. Practically, in the configuration shown in FIG. 8, an air passage 200 is formed using a through hole opened through the resin-made first substrate 20. Instead of this, the air passage 200 may also be formed through the second substrate 30.

Figure 7A:
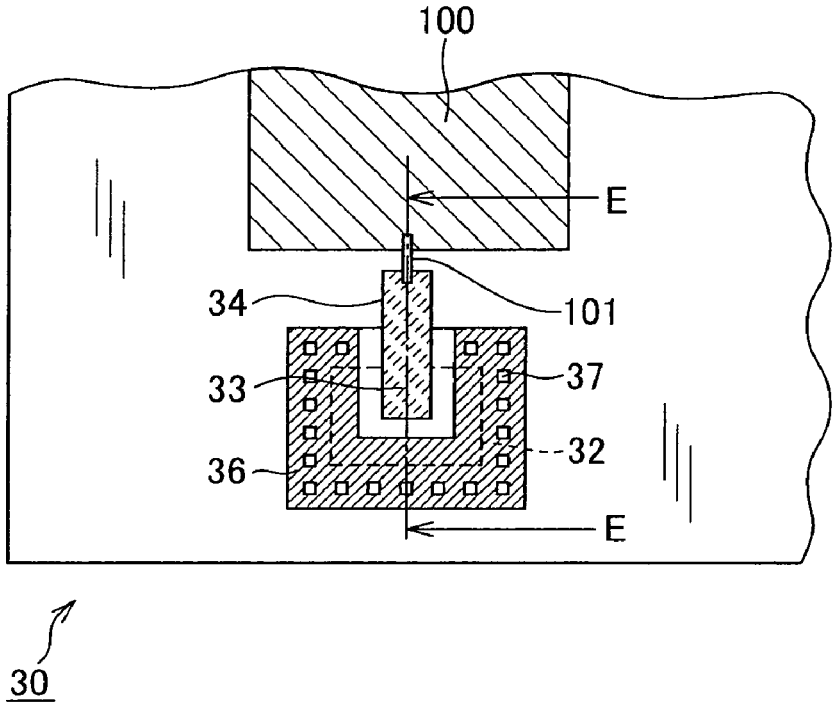
FIG. 7A is a planar view showing a configuration according to a modification of the embodiments.
Figure 7B:
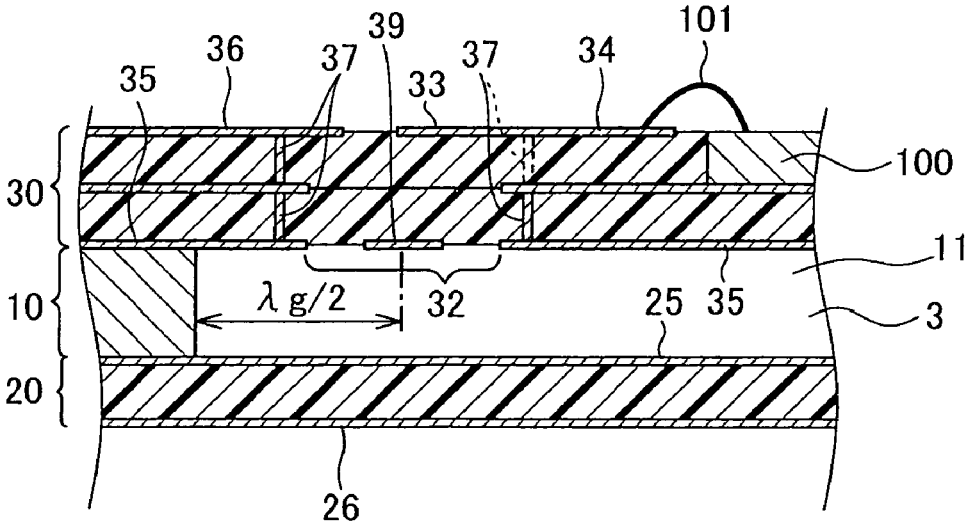
FIG. 7B is a cross-sectional view showing a section along an E-E line taken in FIG. 7A.

Here, FIGS. 7A and 7B are diagrams showing a modification of the to above-described high frequency signal transmitting devices 1 and 5. FIG. 7A is an enlarged planar view from a surface at which the transition 33 is formed, and shows a vicinity of the transition 33 formed on the second substrate 30. FIG. 7B is a cross-sectional view showing a section along the E-E line taken of FIG. 7A.

As shown in FIG. 7A, according to the high frequency signal transmitting device 1 (5), at a center periphery of the each rectangular areas 22, 32 and 52 (in FIG. 7A, referred to as a rectangular area 32 of the second substrate 30) of the first substrate 20 (50) and the second substrate 30, a matching device 39 including a metallic pattern may be arranged. The matching device eliminates unwanted reflection at a portion to be connected to the waveguide around where via holes are arranged. Hence, an efficiency of the transmission can be enhanced.

In addition, at least one substrate can be configured as a multi-layered substrate between the first substrate 20 (50) and the second substrate 30 (60). In FIG. 7B, the second substrate 30 is configured as a multi-layered resin made substrate. When a high frequency signal transmitting device 100 (e.g. integrated circuit: IC) is mounted on either side of the first substrate 20 (50) or the second substrate 30 (60) (in FIG. 7B, the second substrate 30), the high frequency signal transmitting device 100 and the high frequency signal line 34 (23, 53) (in FIG. 7B, the high frequency signal line 34) may be electrically connected to each other by a wire 101 (i.e., wire bonding).

Also, on the circuit-formed-surface of the first substrate 20 (50) or the second substrate 30 (60) (in FIGS. 7A and 7B, the second substrate 30), the grounding pattern 26 (36) (in FIGS. 7A and 7B, the grounding pattern 36) may be formed such that the grounding pattern only covers a portion facing to the rectangular area 32 (22, 52) (in FIGS. 7A and 7B, the rectangular area 32). That is, the grounding pattern may not necessarily cover an entire surface except a portion where the circuits are formed.

What is claimed is:

1. A high frequency device comprising:

a waveguide tube unit that transmits a high frequency signal, the waveguide tube unit having a rectangular waveguide passage through which the high frequency signal is transmitted, the waveguide passage extending in a longitudinal direction thereof and having a rectangle section cut perpendicularly to the longitudinal direction, the rectangle section consisting of short side edges and long side edges;

a plate having a thickness corresponding to a length of the short side edges of the waveguide passage and having a through hole formed through the mutually-opposite surface of the plate in a direction of the thickness, the through hole having a width perpendicular to the longitudinal direction, having an inner wall and openings opened at the surfaces and the plate having electrical conductivity in a portion including the inner wall and edges of the openings; and a pair of substrates comprising first and second substrates, each substrate being made of resin and being laminated on each of the mutually-opposite surfaces of the plate and having grounding patterns electrically connected to a ground, the grounding pattern being located at a specified region of a surface of each of the substrates, the specified region positionally corresponding to the waveguide passage formed in the plate, the plate and the pair of substrates forming the waveguide tube unit, the first substrate having an area serving as an input terminal of the high frequency signal being input to the waveguide passage and the second substrate having an area serving as an output terminal of the high frequency signal being transmitted from the waveguide passage, wherein the through hole has an air passage through which the air flows to communicate with space external of the device, the air passage is arranged on at least one of the plate and at least one of the substrates; and the air passage is formed at a portion of one of the first and second substrates at which no grounding pattern is formed.

2. The device according to claim 1, wherein the pair of substrates is configured by at least one multi-layered substrate and at least one slit as an output portion provided for emitting electromagnetic waves is formed on the grounding pattern that covers the through hole of the plate of the second substrate from which the electromagnetic waves are transmitted externally.

3. The device according to claim 1, wherein the air passage is provided by a groove that is formed on a joint surface at which the plate and one of the first and second substrates are joined to each other.

4. The device according to claim 1, wherein the plate is configured by a metallic plate having the through hole.

5. The device according to claim 1, wherein the plate and the first and second substrates are joined with a conductive adhesive and the air passage is formed at a portion at which no conductive adhesive is applied.

6. The device according to claim 1, wherein the plate is configured by a substrate which is made of resin which and an electrical conductive pattern formed at the inner wall and the edge portion of the openings at the through hole.

7. The device according to claim 1, wherein a bore-through waveguide is formed so as to form an E bend such that the bore-through waveguide is formed through the pair of substrates with a plurality of via holes arranged around portions for the input and output terminals for the waveguide so as to form the E bend.

8. The device according to claim 7, wherein a transition that converts between electromagnetic waves transmitted from the bore-through waveguide and the high frequency signal, is formed at an opening of the bore-through waveguide on a surface opposed to a joint surface between each of the pair of substrates and the plate.

9. A high frequency device comprising:

a waveguide tube unit that transmits a high frequency signal, the waveguide tube unit having a rectangular waveguide passage through which the high frequency signal is transmitted, the waveguide passage extending in a longitudinal direction thereof and having a rectangle section cut perpendicularly to the longitudinal direction, the rectangle section consisting of short side edges and long side edges;

a plate having a thickness corresponding to a length of the short side edges of the waveguide passage and having a through hole formed through the mutually-opposite surface of the plate in a direction of the thickness, the through hole having a width perpendicular to the longitudinal direction, having an inner wall and openings opened at the surfaces and the plate having electrical conductivity in a portion including the inner wall and edges of the openings; and a pair of substrates comprising first and second substrates, each substrate being made of resin and being laminated on each of the mutually-opposite surfaces of the plate and having grounding patterns electrically connected to a ground, the grounding pattern being located at a specified region of a surface of each of the substrates, the specified region positionally corresponding to the waveguide passage formed in the plate, the plate and the pair of substrates forming the waveguide tube unit, the first substrate having an area serving as an input terminal of the high frequency signal being input to the waveguide passage and the second substrate having an area serving as an output terminal of the high frequency signal being transmitted from the waveguide passage, wherein the through hole has an air passage through which the air flows to communicate with space external of the device, the air passage is arranged on at least one of the plate and at least one of the substrates;

a bore-through waveguide is formed so as to form an E bend such that the bore-through waveguide is formed through the pair of substrates with a plurality of via holes arranged around portions for the input and output terminals for the waveguide so as to form the E bend; and the bore-through waveguide is formed such that a center portion of the bore-through waveguide is formed to be at a portion that is $\lambda g/2$ away from an end portion of the waveguide tube unit, where $\lambda g$ is referred to wavelength of electromagnetic waves to be transmitted in the waveguide tube unit.

10. A high frequency device comprising:

a waveguide tube unit that transmits a high frequency signal, the waveguide tube unit having a rectangular waveguide passage through which the high frequency signal is transmitted, the waveguide passage extending in a longitudinal direction thereof and having a rectangle section cut perpendicularly to the longitudinal direction, the rectangle section consisting of short side edges and long side edges;

a plate having a thickness corresponding to a length of the short side edges of the waveguide passage and having a through hole formed through the mutually-opposite surface of the plate in a direction of the thickness, the through hole having a width perpendicular to the longitudinal direction, having an inner wall and openings opened at the surfaces and the plate having electrical conductivity in a portion including the inner wall and edges of the openings; and a pair of substrates comprising first and second substrates, each substrate being made of resin and being laminated on each of the mutually-opposite surfaces of the plate and having grounding patterns electrically connected to a ground, the grounding pattern being located at a specified region of a surface of each of the substrates, the specified region positionally corresponding to the waveguide passage formed in the plate, the plate and the pair of substrates forming the waveguide tube unit, the first substrate having an area serving as an input terminal of the high frequency signal being input to the waveguide passage and the second substrate having an area serving as an output terminal of the high frequency signal being transmitted from the waveguide passage, wherein the through hole has an air passage through which the air flows to communicate with space external of the device, the air passage is arranged on at least one of the plate and at least one of the substrates; and an opening of the air passage is formed such that an end portion at a side of the waveguide passage is formed to be at a portion that is $n \times \lambda g/2$ (n is "0" or positive integer number) away from an end portion of the waveguide tube unit, where $\lambda g$ is referred to wavelength of electromagnetic waves to be transmitted in the waveguide tube unit.

11. A high frequency device comprising:

a waveguide tube unit that transmits a high frequency signal, the waveguide tube unit having a rectangular waveguide passage through which the high frequency signal is transmitted, the waveguide passage extending in a longitudinal direction thereof and having a rectangle section cut perpendicularly to the longitudinal direction, the rectangle section consisting of short side edges and long side edges;

a plate having a thickness corresponding to a length of the short side edges of the waveguide passage and having a through hole formed through the mutually-opposite surface of the plate in a direction of the thickness, the through hole having a width perpendicular to the longitudinal direction, having an inner wall and openings opened at the surfaces and the plate having electrical conductivity in a portion including the inner wall and edges of the openings; and a pair of substrates comprising first and second substrates, each substrate being made of resin and being laminated on each of the mutually-opposite surfaces of the plate and having grounding patterns electrically connected to a ground, the grounding pattern being located at a specified region of a surface of each of the substrates, the specified region positionally corresponding to the waveguide passage formed in the plate, the plate and the pair of substrates forming the waveguide tube unit, the first substrate having an area serving as an input terminal of the high frequency signal being input to the waveguide passage and the second substrate having an area serving as an output terminal of the high frequency signal being transmitted from the waveguide passage, wherein the through hole has an air passage through which the air flows to communicate with space external of the device, the air passage is arranged on at least one of the plate and at least one of the substrates;

a bore-through waveguide is formed so as to form an E bend such that the bore-through waveguide is formed through the pair of substrates with a plurality of via holes arranged around portions for the input and output terminals for the waveguide so as to form the E bend; and a matching device is arranged at a portion surrounded by the via holes on the second substrate from which electromagnetic waves are transmitted externally.

12. A high frequency device comprising:

a waveguide tube unit that transmits a high frequency signal, the waveguide tube unit having a rectangular waveguide passage through which the high frequency signal is transmitted, the waveguide passage extending in a longitudinal direction thereof and having a rectangle section cut perpendicularly to the longitudinal direction, the rectangle section consisting of short side edges and long side edges;

a plate having a thickness corresponding to a length of the short side edges of the waveguide passage and having a through hole formed through the mutually-opposite surface of the plate in a direction of the thickness, the through hole having a width perpendicular to the longitudinal direction, having an inner wall and openings opened at the surfaces and the plate having electrical conductivity in a portion including the inner wall and edges of the openings; and a pair of substrates comprising first and second substrates, each substrate being made of resin and being laminated on each of the mutually-opposite surfaces of the plate and having grounding patterns electrically connected to a ground, the grounding pattern being located at a specified region of a surface of each of the substrates, the specified region positionally corresponding to the waveguide passage formed in the plate, the plate and the pair of substrates forming the waveguide tube unit, the first substrate having an area serving as an input terminal of the high frequency signal being input to the waveguide passage and the second substrate having an area serving as an output terminal of the high frequency signal being transmitted from the waveguide passage, wherein the through hole has an air passage through which the air flows to communicate with space external of the device, the air passage is arranged on at least one of the plate and at least one of the substrates; and an aperture of the air passage is equal or less than $\lambda/4$, where $\lambda$ is referred to free space wavelength of electromagnetic waves to be transmitted.

13. A high frequency device comprising:

a waveguide tube unit that transmits a high frequency signal, the waveguide tube unit having a rectangular waveguide passage through which the high frequency signal is transmitted, the waveguide passage extending in a longitudinal direction thereof and having a rectangle section cut perpendicularly to the longitudinal direction, the rectangle section consisting of short side edges and long side edges;

a plate having a thickness corresponding to a length of the short side edges of the waveguide passage and having a through hole formed through the mutually-opposite surface of the plate in a direction of the thickness, the through hole having a width perpendicular to the longitudinal direction, having an inner wall and openings opened at the surfaces and the plate having electrical conductivity in a portion including the inner wall and edges of the openings; and a pair of substrates comprising first and second substrates, each substrate being made of resin and being laminated on each of the mutually-opposite surfaces of the plate and having grounding patterns electrically connected to a ground, the grounding pattern being located at a specified region of a surface of each of the substrates, the specified region positionally corresponding to the waveguide passage formed in the plate, the plate and the pair of substrates forming the waveguide tube unit, the first substrate having an area serving as an input terminal of the high frequency signal being input to the waveguide passage and the second substrate having an area serving as an output terminal of the high frequency signal being transmitted from the waveguide passage, wherein the through hole has an air passage through which the air flows to communicate with space external of the device, the air passage is arranged on at least one of the plate and at least one of the substrates;

the pair of substrate is configured by at least one multi-layered substrate and at least one slit as an output portion provided for emitting the electromagnetic waves is formed on the grounding pattern that covers the through hole of the plate of the second substrate from which electromagnetic waves are transmitted externally; and a matching device including an electrical conductive pattern is formed on the second substrate at which the at least one slit is formed such that the matching device is formed on a surface opposed to a surface where the at least one slit is formed and at a portion facing to the portion at which the at least one slit is formed.

14. A high frequency device comprising:

a waveguide tube unit that transmits a high frequency signal, the waveguide tube unit having a rectangular waveguide passage through which the high frequency signal is transmitted, the waveguide passage extending in a longitudinal direction thereof and having a rectangle section cut perpendicularly to the longitudinal direction, the rectangle section consisting of short side edges and long side edges;

a plate having a thickness corresponding to a length of the short side edges of the waveguide passage and having a through hole formed through the mutually-opposite surface of the plate in a direction of the thickness, the through hole having a width perpendicular to the longitudinal direction, having an inner wall and openings opened at the surfaces and the plate having electrical conductivity in a portion including the inner wall and edges of the openings;

a pair of substrates comprising first and second substrates, each substrate being made of resin and being laminated on each of the mutually-opposite surfaces of the plate and having grounding patterns electrically connected to a ground, the grounding pattern being located at a specified region of a surface of each of the substrates, the specified region positionally corresponding to the waveguide passage formed in the plate, the plate and the pair of substrates forming the waveguide tube unit, the first substrate having an area serving as an input terminal of the high frequency signal being input to the waveguide passage and the second substrate having an area serving as an output terminal of the high frequency signal being transmitted from the waveguide passage, and at least one high frequency circuit component mounted directly to the first substrate; wherein the through hole has an air passage through which the air flows to communicate with space external of the device, the air passage is arranged on at least one of the plate and at least one of the substrates.

15. The device according to claim 14, further comprising at least one other high frequency circuit component mounted directly to the second substrate.

* * * * *